US008230552B2

(12) United States Patent
Klugh et al.

(10) Patent No.: US 8,230,552 B2
(45) Date of Patent: Jul. 31, 2012

(54) NOVELTY GLIDERS FOR WALKERS

(76) Inventors: Louise Ann Klugh, Dartmouth, MA (US); Dawn Louise Cunha, Dartmouth, MA (US); Heidi Jean Correia, Dartmouth, MA (US)

( * ) Notice: Subject to any disclaimer, the term of this patent is extended or adjusted under 35 U.S.C. 154(b) by 757 days.

(21) Appl. No.: 12/236,600

(22) Filed: Sep. 24, 2008

(65) Prior Publication Data

US 2010/0071166 A1 Mar. 25, 2010

(51) Int. Cl.
*A47B 91/06* (2006.01)

(52) U.S. Cl. ..... 16/42 R; 16/21; 16/24; 16/26; 16/33; 16/42 T

(58) Field of Classification Search ..... 16/21, 24, 16/26, 33, 42 R, 42 T; 29/458; 215/355
See application file for complete search history.

(56) References Cited

U.S. PATENT DOCUMENTS

| | | | | | |
|---|---|---|---|---|---|
| 1,212,220 | A | * | 1/1917 | Hight | 16/42 R |
| 1,263,974 | A | * | 4/1918 | Whidden | 16/42 R |
| 1,334,496 | A | * | 3/1920 | Johnson | 16/42 R |
| RE14,964 | E | * | 10/1920 | Anderson | 248/616 |
| 1,888,037 | A | * | 11/1932 | Herold | 16/42 R |
| 1,903,609 | A | * | 4/1933 | Uhl | 16/42 R |
| 1,937,438 | A | * | 11/1933 | Schacht | 16/42 T |
| 2,030,649 | A | * | 2/1936 | Miller | 16/42 R |
| 2,262,063 | A | * | 11/1941 | Swarr | 16/42 R |
| 2,744,283 | A | * | 5/1956 | Reineman | 16/42 R |
| 2,973,545 | A | * | 3/1961 | Kramcsak, Jr. | 16/42 R |
| 3,065,494 | A | * | 11/1962 | Kramcsak, Jr. et al. | 16/42 R |
| 4,074,742 | A | * | 2/1978 | Chamblin | 152/154.2 |
| 4,226,274 | A | * | 10/1980 | Awaya et al. | 152/154.2 |
| 6,095,739 | A | * | 8/2000 | Albertson et al. | 411/439 |
| 7,234,200 | B2 | * | 6/2007 | Chase | 16/42 R |

* cited by examiner

*Primary Examiner* — Victor Batson
*Assistant Examiner* — Roberta Delisle

(57) ABSTRACT

A glider that attaches to the bottom of the legs of a walker is disclosed. The glider, preferably a ball made from wood, provides the walker with additional stability and mobility. The glider includes a hole with a rubber stopper that secures the glider to the leg of a walker. A screw is first inserted into the glider and then a design is created on the glider. The screw is removed and then a hole is drilled over the same spot, large enough to fit the leg of a walker. A rubber stopper is inserted into the hole to help secure the leg of the walker to the glider. A scribe line can be included around the opposite end of the glider to inform users of when to replace the glider.

9 Claims, 3 Drawing Sheets

NOVELTY GLIDERS FOR WALKERS

CROSS REFERENCE TO RELATED APPLICATIONS

This application is a non-provisional application of U.S. Application 60/922,270 that was filed on Oct. 3, 2007, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of medical walker accessories, and more specifically toward a glider that attaches to the bottom of the legs of a walker. The glider, preferably a ball made from wood, provides the walker with additional stability and mobility. The glider includes a hole with a rubber stopper that secures the glider to the leg of a walker. A screw is first inserted into the glider and then a design is created on the glider. The screw is removed and then a hole is drilled over the same spot, large enough to fit the leg of a walker. A rubber stopper is inserted into the hole to help secure the leg of the walker to the glider. A scribe line can be included around the opposite end of the glider to inform users of when to replace the glider.

Walkers aid individuals that have difficult walking. A user grasps the walker and moves the walker forward while walking themselves, using the walker for support when needed. Walkers generally have four legs and the legs tend to remain on or close to the ground while in use. The user slides the walker along the ground as they step forward. While it is common that the front legs of the walker include wheels to aid in moving the walker forward as the user walks, it is rare for all the legs to include wheels as this also would create an unstable platform to provide support to the user. When the user slides the walker along an uneven surface, the rear legs of the walker can catch and cause the walker to abruptly stop. This can cause the user to lose his or her balance and can lead to serious injury. Further, without some form of a glider on the rear legs, the walker can begin to move too fast, especially when traveling down hill. Therefore, there is a need for an apparatus to enable walkers to easily, efficiently, and fashionably glide along the ground to safely support the user.

One common solution to this problem known in the prior art is to cut holes into a tennis ball and slide this ball over the front leg of a walker. However, tennis balls do not allow the walker to easily glide over semi-rough surfaces, such as asphalt or rough gravel. Further, the tennis balls attached to the bottom of the legs of the walker wear down quickly during normal use, and must be replaced often. Tennis balls only work properly when they still have their cushioning layer of green fuzz over the inner rubber layer. Once the green fuzz wears down, rubber layer is exposed and the tennis ball no longer allows the walker to glide. In fact, the walker leg can bore a hole right through the tennis ball and cause damage to floors as the walker is moved across the surface. Cutting a tennis ball is also dangerous, as it is difficult to cut a hole in the tennis ball to the appropriate size and shape and it requires the use of sharp tools. Also, the tennis balls are not aesthetically pleasing.

U.S. Patent Application 2007/0175503 to Gordon teaches an assistive walking device that uses three or more spherical structures attached to a support structure or frame. These spherical structures are made from metal or plastic. However, Gordon does not teach an apparatus that attaches and secures to existing walker devices where the apparatus is aesthetically pleasing. Additionally, Gordon teaches using at least 3 spherical structures as opposed to the two gliders contemplated by the current invention.

U.S. Patent Application 2006/0272691 to DeLesline discloses a boot for a walker that replaces the rubber tip commonly used on walkers. The boot is made from a durable wear resistant material with a hardness greater than that of a rubber tip. However, DeLesline does not contemplate an aesthetically pleasing ball made from wood that can quickly and easily be attached and secured to the leg of a walker.

U.S. Pat. No. 7,234,200 to Chase teaches a glide assembly that is adapted to be mounted to a free end of a leg of a piece of furniture. The glide assembly includes a spherical structure with a bored hole. The leg of the furniture can be inserted into the bored hole. However, Chase does not teach a glider that is attached to the leg of a walker. Further, Chase does not teach of placing designs or otherwise making the glider aesthetically pleasing. Unlike the current invention, there is no rubber stopper located within the bored hole of the glider to help retain the glider on the leg.

Thus there has existed a long-felt need for a glider that can quickly and efficiently attach and secure to the legs of a walker to allow the walker to glide across smooth and rough surfaces. It should be made of a durable material such as wood and be easy and cost effective to manufacture. Further, the glider should be aesthetically pleasing.

The current invention provides just such a solution by having a glider that attaches to the bottom of the legs of a walker. The glider, preferably a ball made from wood, provides the walker with additional stability and mobility. The glider includes a hole with a rubber stopper that secures the glider to the leg of a walker. A screw is first inserted into the glider and then a design is created on the glider. The screw is removed and then a hole is drilled over the same spot, large enough to fit the leg of a walker. A rubber stopper is inserted into the hole to help secure the leg of the walker to the glider. A scribe line can be included around the opposite end of the glider to inform users of when to replace the glider.

SUMMARY OF THE INVENTION

The current invention is a glider attachment that easily attaches to the bottom of the leg of a walker. The glider is preferably a ball made of wood with a bored hole. The bored hole should be of sufficient size to fit the leg of a walker. On the opposite side of the glider from the bored hole, there is a circular scribe line that defines the bottom portion of the glider. The bottom portion of the glider wears down over time and the entire glider should be replaced when it is worn beyond the scribe line. The remaining portion of the glider can have certain designs affixed thereto.

It is a principal object of the invention to provide a device that reduces the resistance of a walker as it is moved across a surface.

It is another object of the invention to provide a device that protects the legs of a walker.

It is a further object of the invention to provide a device that can easily attach and secure to an existing walker.

It is a final object of this invention to provide a device that attaches to the leg of a walker that is also aesthetically pleasing.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

DETAILED DESCRIPTION OF THE INVENTION

Figure 1:
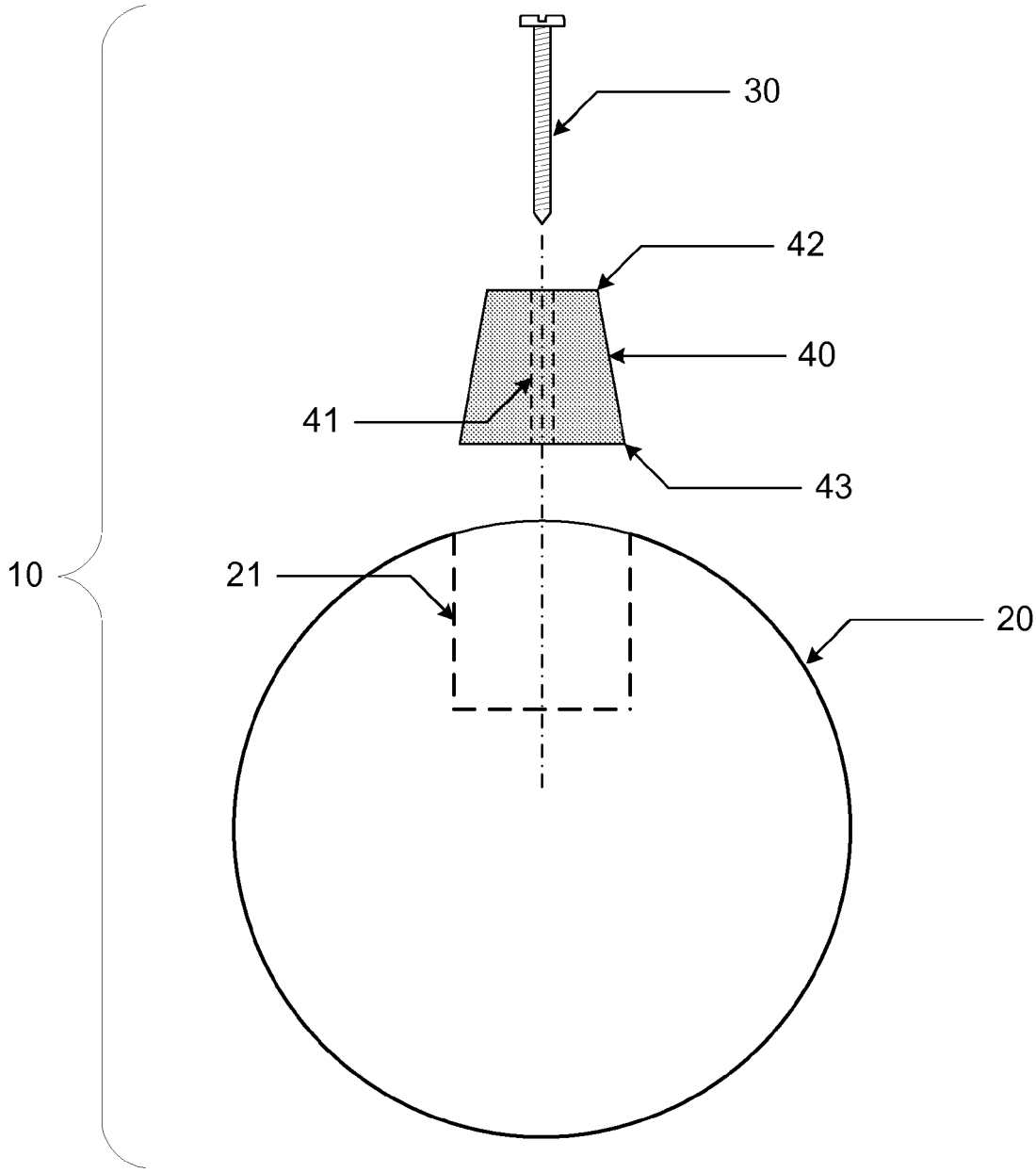
FIG. 1 is an exploded front view of the current invention.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a cutaway exploded front view of the current invention. The current invention is a glider 10 that is intended to be secured to the bottom of the leg of a walker. The glider 10 includes a base portion 20 that, in this figure, is spherical in shape. A hole 21 is included in the base portion. The hole 21 is of a sufficient size to fit the leg of a walker. A rubber stopper 40 is also used with the glider 10, where the rubber stopper has a bottom diameter 43 and an upper diameter 42. The bottom diameter 43 is preferably wider than the upper diameter 42. However, the largest diameter of the rubber stopper 40 should be small enough to fit inside the leg of a walker. The rubber stopper 40 also includes a hole 41. The hole should be large enough to fit a screw 30 that is used to secure the rubber stopper 40 to the base portion 20.

Figure 2:
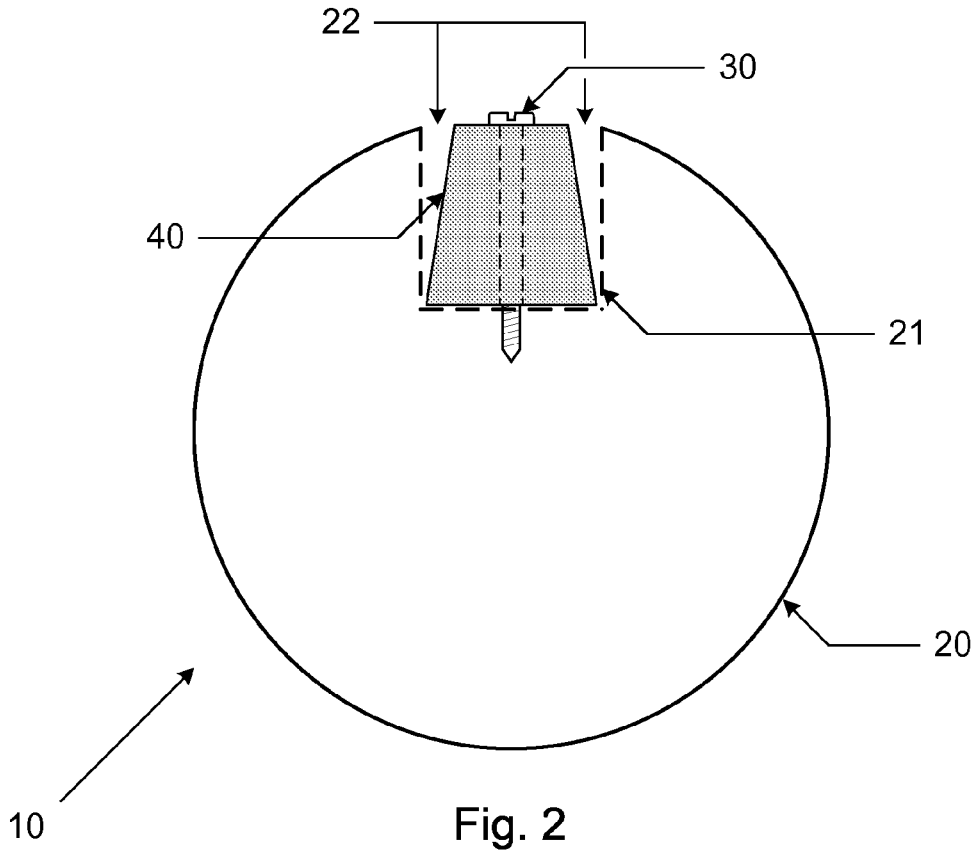
FIG. 2 is a collapsed front view of the current invention.

FIG. 2 is a cutaway collapsed front view of the current invention. The glider 10 includes a base portion 20 that, in this figure, is spherical in shape. A hole 21 is included in the base portion. The hole 21 is of a sufficient size to fit the leg of a walker. A rubber stopper 40 is also used with the glider 10 and is secured within the base 20 by a screw 30. When the rubber stopper 40 is secured to the base 20 a void 22 is created, where the void is a space sufficient to house the leg of a walker.

Figure 3:
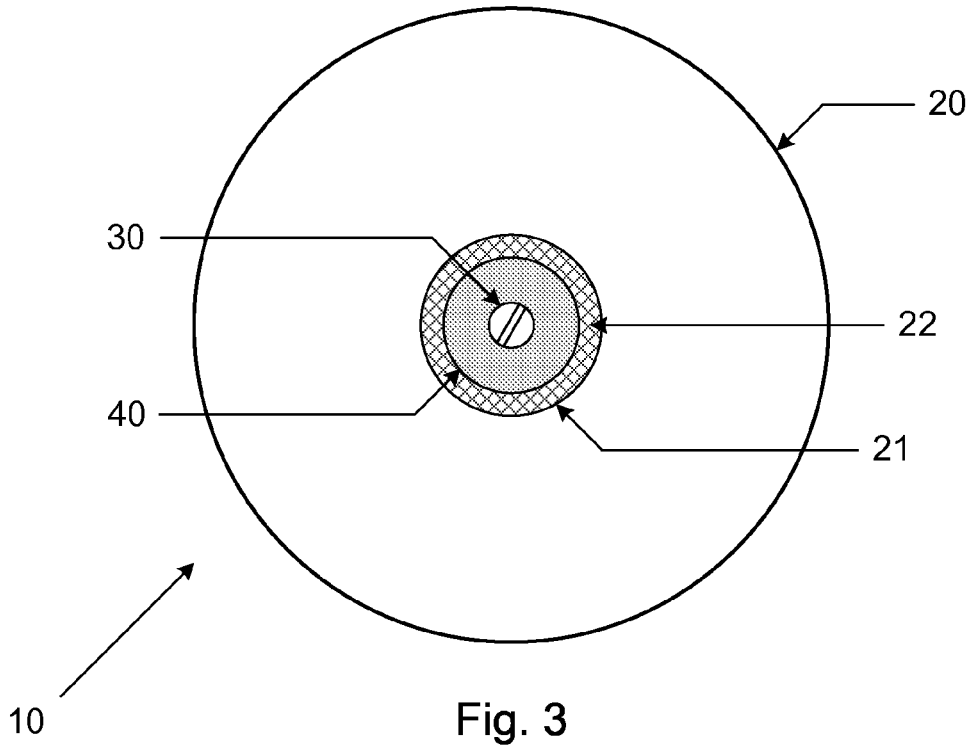
FIG. 3 is a top view of the current invention.

FIG. 3 is a top view of the current invention. The glider includes a base 20 with a hole 21. A rubber stopper 40 is secured to the base 20 by a screw 30 in the hole 21. A void is created between the rubber stopper 40 and the base 20. The void 22 is an empty space that can fit the cylindrical leg of a walker.

Figure 4:
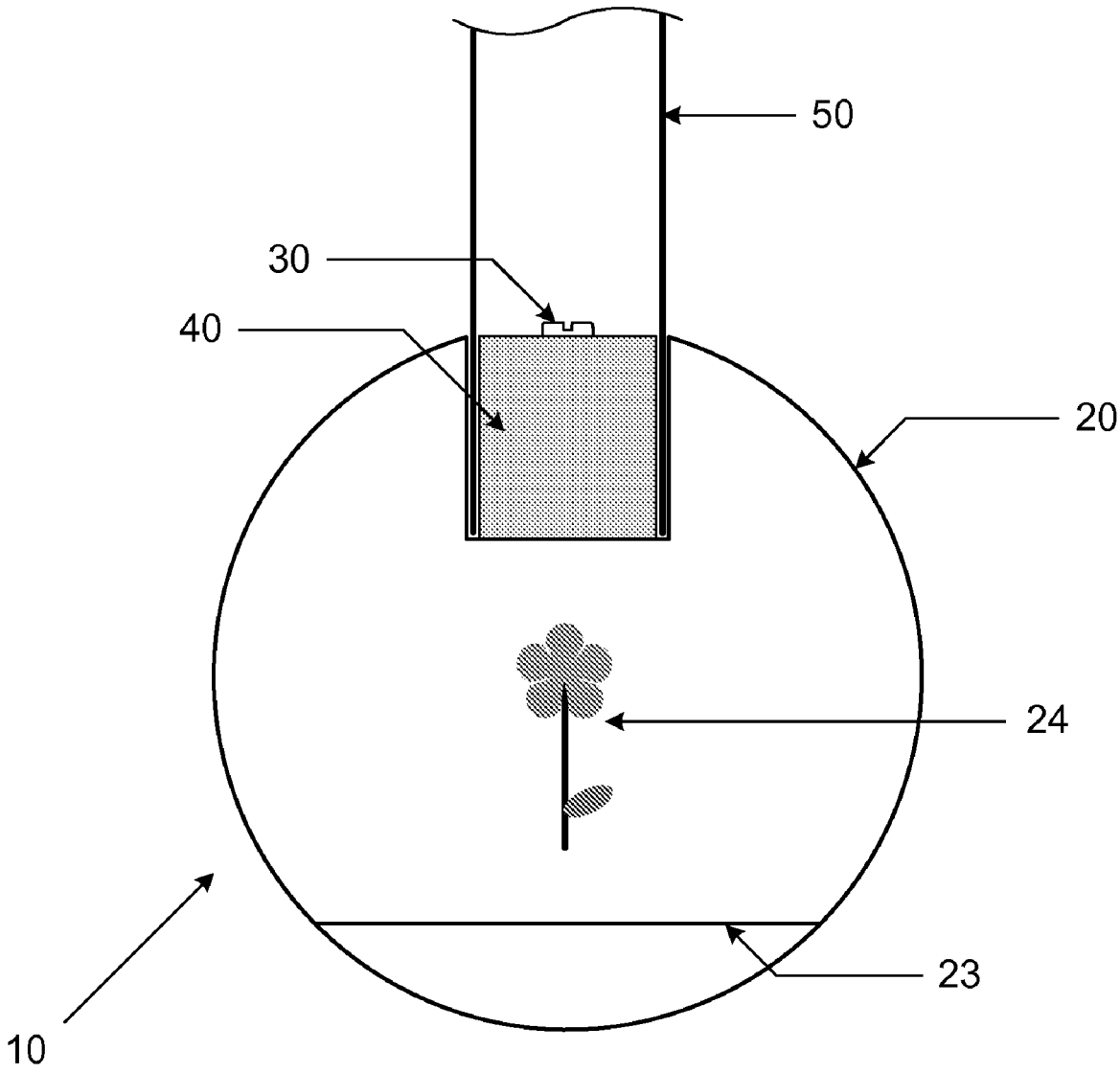
FIG. 4 is a front view of the current invention attached to the leg of a walker.

FIG. 4 is a cutaway front view of the current invention attached to the leg of a walker. The glider 10 includes a base 20. In this figure, there is a design 24 affixed to the side of the base 20. A scribe line 23 is drawn around the bottom of the base 20. A rubber stopper 40 is secured to the base 20 by a screw 30. The leg of a walker 50 is secured to the glider 10 by sliding it between the base 20 and the rubber stopper 40. The friction of the rubber stopper 40 against the leg of the walker 50 maintains the glider 10 on the leg of the walker 50 as a user moves the walker across the ground.

The glider is secured to the leg of a walker by placing the leg of a walker into the void between the rubber stopper and the base. The rubber stopper is coaxially located within the leg of the walker and frictional forces retain the glider on the leg of the walker. The preferable graduated diameter of the rubber stopper increases the frictional forces as the leg of the walker is pushed further into the hole.

The walker glides along the ground with greater ease than it would without the glider. Because of the larger base of the glider, the walker can easily move over rough and uneven surfaces, such as rough asphalt, gravel, door jams, and uneven concrete. However, the base will slowly wear down through use. Therefore, the glider should be replaced periodically. The scribe line drawn around the bottom of the base can be used as an indicator of when the glider should be replaced. Once the base of the glider has been worn to or above the scribe line, it should be replaced.

Several steps are involved in making gliders according to the current invention. A base is selected and drilled with a small pilot hole. Then, a scribe line is added around the bottom of the base, opposite from the screw. Many different methods are contemplated to add the scribe line to the bottom of the base, including drawing, etching, and burning. The area beneath the scribe line is not intended to be painted or otherwise modified from the original structure. After the scribe line has been drawn, a screw is screwed into the small pilot hole and is used to hold the base for the next few steps. The base is then sanded and/or otherwise primed above the scribe line. This allows the base to readily accept painted designs, decorative attachments, or other decorations to make the glider aesthetically pleasing.

Once the base is sanded and/or primed, designs are painted on the base, decorative attachments are affixed to the surface of the base, or otherwise decorated to make the glider more aesthetically pleasing. After the base has been appropriately decorated, the screw is removed from the small pilot hole and the base is drilled with a hole over the small pilot hole. The hole should be of a sufficient width and depth to accept the leg of a walker. Preferably, the hole is drilled to a depth of 1 inch with a diameter of 1.125 inches. However, the inventors contemplate that the hole can be a different depth or diameter to meet the dimensional requirements of the walker that is used with the glider. After drilling the hole, the hole is primed and/or painted because a portion of the hole may be visible after the leg of the walker is inserted into the hole.

After the hole has been drilled and primed and/or painted, the finishing touches are placed on the base. The scribe line is once again drawn around the bottom of the base, preferably over the first scribe line. This is done for clarification and to make it match the design on the base. Additionally, words are added near the scribe line, such as "Replace Line" to alert the user of the glider when the glider should be replaced. Other words or phrases can include substitute line, replace, replace now, stop line, time to replace, wear line, or any other terminology that has a similar meaning. Further the words can be written in different languages to aid those that speak other languages.

The glider is then inspected and any finished touches to the design are made. Upon completing inspection, the base is sealed, preferably with an acrylic sealer. Other sealers are contemplated by the inventors, including gloss, matte, flat, clear milky, waterproofing, varnishing, and polyurethane sealers as well as shellac coatings and metallic platings, such as gold, silver, copper, and nickel.

Placing a rubber stopper in the hole and permanently securing it to the base with a screw finishes the glider. The void created between the base and the rubber stopper fits and secures a leg of a walker to the glider. While not necessary, it may be preferable to drill a smaller hole in the middle of the larger hole in the base to act as a pilot hole to aid the screw being screwed into the base. The screw is preferably a #10 1½ inch sheet metal screw, but can also be different sized screws. Alternatives to screws are also contemplated. For example, nails or rivets can be used. Adhesives can also be used to attach the rubber stopper to the base. The rubber stopper is preferably a #5 EPDM rubber stopper with a hole. However, other rubber pieces, grommets, cork, plastic, and nylon are also contemplated as being used as the rubber stopper to coaxially secure the leg of the walker to the base.

While a specific order has been laid out above, it is nonetheless possible that the steps be performed in a different order to achieve the same goal. For example, the scribe line could first be drawn around the base after the screw has been inserted into the pilot hole.

The base is preferably made from wood and is spherical in shape. Various types of woods can be used, such as oak, cherry, bamboo, pine, beech, and redwood. Other types of materials can be used for the base as well, such as plastic, nylon, acrylic, metals, metal alloys, rubber, plaster, ceramics, fiberglass, and other synthetic materials. Further, geometric shapes other than spheres are possible without deviating from the scope of the invention. Some of these shapes can include cubes, pyramids, cones, cylinders, and prisms.

The designs on the base are preferably hand painted. Preferably, designs are hand drafted and stenciled on the base. Various methods for painting are possible, including spraying, brushing, dipping, rubbing, sponging, and wiping. Further, the base can be automatically painted by machine. Alternatively or in addition to painting the base, designs can be applied to the base by silk screening, carving, burning, whittling, cutting, or staining. Also, decals or stickers can be applied to the surface of the base. Other attachments, such as fabrics, metals, or other materials can be secured to the base to add to the design.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

What I claim is:

1. A glide device for enabling a walker to glide over a surface, comprising:

a generally spherical base and a rubber stopper, the base comprising a hole and having a bottom, the bottom being on an opposite side of the base from the hole, the hole having a minimum diameter, the rubber stopper having a maximum diameter, the minimum diameter of the hole being wider than the maximum diameter of the rubber stopper, and wherein the rubber stopper is positioned in the hole when assembled and is shaped to create a void with the base sufficient to house the leg of a walker, and the rubber stopper is configured to fit inside the leg of a walker, wherein a screw extends through the rubber stopper and into the base.

2. The device of claim 1, further comprising a screw, where the screw secures the rubber stopper to the base inside of the hole.

3. The device of claim 1, further comprising a scribe line, where the scribe line is a line located around the bottom of the base.

4. The device of claim 3, further comprising words, where the words are written proximate to the scribe line, where the words convey to the user that the device should be replaced if worn above the scribe line.

5. The device of claim 3, where the words are selected from the group consisting of replace line, substitute line, replace, replace now, stop line, time to replace, and wear line.

6. The device of claim 1, further comprising a design, where the design is affixed to a surface of the base.

7. The device of claim 1, where the base is manufactured from wood.

8. The device of claim 1, where the hole is substantially cylindrical, where the minimum diameter of the hole is at least 1.125 inches and the hole has a depth of at least 1 inch.

9. The device of claim 1, where the rubber stopper is substantially cylindrical, where the maximum diameter of the rubber stopper is no larger than 1.125 inches.

* * * * *